US012807382B2

(12) United States Patent
Xu et al.

(10) Patent No.: US 12,807,382 B2
(45) Date of Patent: Nov. 24, 2026

(54) STORAGE CONTAINER

(71) Applicant: DELI GROUP CO. LTD, Ningbo (CN)

(72) Inventors: Kangjin Xu, Ningbo (CN); Chengjun Pan, Ningbo (CN); Yangfang Cheng, Ningbo (CN); Hongyu Qi, Ningbo (CN)

(73) Assignee: DELI GROUP CO. LTD, Ningbo (CN)

( * ) Notice: Subject to any disclaimer, the term of this patent is extended or adjusted under 35 U.S.C. 154(b) by 0 days.

(21) Appl. No.: 19/080,901

(22) Filed: Mar. 16, 2025

(65) Prior Publication Data

US 2026/0015141 A1 Jan. 15, 2026

(30) Foreign Application Priority Data

Jul. 12, 2024 (CN) ..... 202410940464.4

(51) Int. Cl.
*B65D 39/12* (2006.01)
*B65D 39/00* (2006.01)
(Continued)

(52) U.S. Cl.
CPC ..... *B65D 55/12* (2013.01); *B65D 43/021* (2013.01); *B65D 2255/06* (2013.01); *B65D 2255/20* (2013.01); *B65D 2543/0049* (2013.01)

(58) Field of Classification Search
CPC .. A47J 47/02; A47J 47/06; A47J 47/10; A47J 41/0022; B65D 39/12; B65D 41/023;
(Continued)

(56) References Cited

U.S. PATENT DOCUMENTS 299,676 A * 6/1884 Poland ..... B65D 39/12 215/361
4,942,970 A * 7/1990 Jay ..... B65D 39/12 215/358

(Continued)

FOREIGN PATENT DOCUMENTS

CN 201538484 U 8/2010
CN 204310203 U 5/2015

(Continued)

OTHER PUBLICATIONS

The First Search Report of the counterpart priority CN application No. 202410940464.4 issued on Jun. 27, 2025.

(Continued)

*Primary Examiner* — Gideon R Weinerth
(74) *Attorney, Agent, or Firm* — The Sun IP Law

(57) ABSTRACT

A container body, provided with a storage cavity and an opening in communication with the storage cavity; and a container cover, covering the opening of the container body, the container cover including an upper cover, a press locking portion, a lateral unlocking portion, and a sealing cover, the upper cover being provided with a mounting recess, the press locking portion being movably arranged in the mounting recess, the lateral unlocking portion being arranged on a side portion of the press locking portion, and the sealing cover being located in the storage cavity and linked to the press locking portion; when the press locking portion is pressed downwards to a locking position, the sealing cover closes the opening; and when subjected to a lateral pressing force, the lateral unlocking portion unlocks the press locking portion, and the sealing cover opens the opening.

18 Claims, 10 Drawing Sheets

(51) Int. Cl.
*B65D 43/02* (2006.01)
*B65D 45/32* (2006.01)
*B65D 55/12* (2006.01)

(58) Field of Classification Search
CPC .... B65D 43/021; B65D 45/327; B65D 45/34; B65D 45/345; B65D 51/1683; B65D 51/242; B65D 55/12; B65D 2255/06; B65D 2255/20; B65D 2543/0049; B65D 2543/00925; B65D 2543/00564; B65D 39/16; B65D 43/022; B65D 43/26; B65D 53/02; B65D 2543/00203; B65D 2543/00935; B65D 2543/00972; B65D 2255/00; Y10S 292/37; Y10S 277/915
USPC ..... 206/1.5; 215/201, 272, 360, 358, 361, 215/359
See application file for complete search history.

(56) References Cited

U.S. PATENT DOCUMENTS 7,204,383 B2 * 4/2007 Hsu ..... B65D 39/12 220/803
7,815,067 B2 * 10/2010 Matsumoto ..... B65D 45/327 220/803
10,676,252 B2 * 6/2020 Pentelovitch ..... B65D 45/327
11,267,620 B1 3/2022 Lu
11,524,820 B2 * 12/2022 Pentelovitch ..... B65D 45/327
11,772,850 B1 * 10/2023 Zamora ..... A45F 3/18 215/272
12,065,287 B1 * 8/2024 Hu ..... B65D 39/16
12,162,650 B2 * 12/2024 Peretz Ben-Asher ..... B65D 43/26
12,325,575 B2 * 6/2025 Yao ..... B65D 51/1672
12,643,721 B1 * 6/2026 Ben Asher ..... B65D 43/022
2007/0241107 A1 * 10/2007 Matsumoto ..... B65D 39/12 220/238
2016/0107805 A1 * 4/2016 Luo ..... A47J 47/02 220/256.1
2018/0050846 A1 * 2/2018 Shao ..... B65D 39/16
2019/0193901 A1 * 6/2019 Pentelovitch ..... B65D 45/327
2021/0284400 A1 * 9/2021 Peretz ..... B65D 43/022
2022/0127050 A1 * 4/2022 Jin ..... B65D 39/16
2023/0145765 A1 * 5/2023 McNamara ..... B65D 55/10 215/340
2023/0348153 A1 * 11/2023 Zhang ..... B65D 53/02
2024/0017890 A1 * 1/2024 Li ..... B65D 43/022
2025/0145338 A1 * 5/2025 Xu ..... B65D 45/32

FOREIGN PATENT DOCUMENTS

CN 207174403 U 4/2018
CN 208360884 U 1/2019
CN 214494070 U 10/2021
CN 113998308 A 2/2022
CN 222947328 U 6/2025

OTHER PUBLICATIONS

The international search report of counterpart PCT application No. PCT/CN2024/114911 issued on Apr. 8, 2025.

* cited by examiner

STORAGE CONTAINER

CROSS-REFERENCE TO RELATED APPLICATIONS

This application claims priority to Chinese Patent Application No. 202410940464.4, filed on Jul. 12, 2024, which is incorporated herein by reference in its entirety.

TECHNICAL FIELD

The present disclosure relates to the technical field of storage containers, and in particular, to a storage container.

BACKGROUND

In daily life, people often eat snacks and fruit, and thus need a storage container to store snacks and fruit. In order to take out food from an accommodating cavity of a traditional food storage and preservation container, people have to rotate a container cover using two hands in conjunction, or open the cover by a large force to take out food. Thus, a traditional food storage and preservation container is inconvenient to operate.

In the related art, in order to solve a problem of inconvenient operation of a storage container, a pressing-type storage container is provided; the pressing-type storage container comprises a container body and a container cover, a button, which moves downwards when pressed and returns upwards when released, is provided at a center of the container cover, and the container cover is closed by single pressing of the button, and the container cover is opened by pressing the button again. Both the opening and the closing of the container cover are triggered by pressing. However, when a user opens the container cover by pressing the button, the button generally springs up, and the user has to wait until the button is lifted in place and then grasp the portion of the lifted button by hand, and then remove the container cover. In this way, a method of pressing and then grasping has a long interval time, being inconvenient for the user to operate, and reducing a user experience.

SUMMARY OF THE INVENTION

The main object of the present disclosure is to provide a storage container, so as to solve a problem of low user experience caused by inconvenient operation of storage containers in the related art.

In order to achieve the object, the present disclosure provides a storage container, including: a container body, provided with a storage cavity and an opening in communication with the storage cavity; and a container cover, covering the opening of the container body, the container cover including an upper cover, a press locking portion, a lateral unlocking portion, and a sealing cover, the upper cover being provided with a mounting recess, the press locking portion being movably arranged in the mounting recess, the lateral unlocking portion being arranged on a side portion of the press locking portion, and the sealing cover being located in the storage cavity and linked to the press locking portion; when the press locking portion is pressed downwards to a locking position, the sealing cover closes the opening; and when subjected to a lateral pressing force, the lateral unlocking portion unlocks the press locking portion, and the sealing cover opens the opening.

In some embodiments, the press locking portion is pressed, the press locking portion and the lateral unlocking portion move together to the locking position, the lateral unlocking portion is in locking fit with the upper cover; and when the lateral unlocking portion is subjected to the lateral pressing force, the lateral unlocking portion and the upper cover are unlocked, so as to unlock the press locking portion.

In some embodiments, the upper cover is provided with a first snap-fitting component, and the lateral unlocking portion includes a second snap-fitting component and an elastic component; the second snap-fitting component is provided on a side portion of the press locking portion, and the elastic component is provided between the second snap-fitting component and the press locking portion, and provides an elastic locking force for the second snap-fitting component; when the press locking portion is pressed downwards, the second snap-fitting component is able to be snap-fitted with the first snap-fitting component; and when the lateral unlocking portion is pressed, the second snap-fitting component is able to be separated from the first snap-fitting component, and the press locking portion is able to drive the sealing cover to open the opening.

In some embodiments, a bottom wall of the upper cover is provided with an operating groove, and the second snap-fitting component is a hook; when the press locking portion is pressed downwards, the hook is able to pass through the operating groove, and hook the bottom wall of the upper cover under an elastic locking acting force of the elastic component; and when the lateral unlocking portion is pressed, the hook is able to be separated from the bottom wall of the upper cover and reach an avoidance area of the operating groove, and the press locking portion is able to drive the hook to be separated from the operating groove.

In some embodiments, a side wall of the mounting recess is provided with an avoidance groove, a first stop portion is formed at a bottom of the avoidance groove, and the hook hooks the bottom wall of the first stop portion once passing through the operating groove.

In some embodiments, a side wall of the press locking portion is provided with an accommodating groove, a bottom wall of the accommodating groove is provided with a guide hole, a side of the hook facing the accommodating groove is provided with a guide post, the guide post is slidably arranged in the guide hole, the elastic component is sleeved on the guide post, a first end of the elastic component abuts the hook, and a second end of the elastic component abuts the bottom wall of the accommodating groove.

In some embodiments, the first snap-fitting component is connected to a bottom wall of the mounting recess, and the first snap-fitting component extends in a direction away from the sealing cover; the second snap-fitting component is rotatably connected with the press locking portion, a side of the press locking portion facing the sealing cover is provided with a second stop portion, the second stop portion extends towards a side where the sealing cover is located, and the elastic component is provided between the second snap-fitting component and the second stop portion.

In some embodiments, one of the first snap-fitting component and the second snap-fitting component includes a hook member, the other of the first snap-fitting component and the second snap-fitting component is provided with a snap groove, and the hook member is able to be snap-fitted with the snap groove or be separated from the snap groove.

In some embodiments, the press locking portion is arranged movably relative to the lateral unlocking portion; when the press locking portion is pressed to the locking position, the press locking portion is in locking fit with the lateral unlocking portion; and when the lateral unlocking portion is subjected to the lateral pressing force, the press locking portion and the lateral unlocking portion are unlocked.

In some embodiments, the press locking portion is provided with a snap-fitting member, and the lateral unlocking portion includes: an unlocking component, rotatably connected with the upper cover, the unlocking component being provided with a pressing part and a snap-fitting part oppositely arranged in an axial direction of the container cover, and a pivot point between the unlocking component and the upper cover being located between the pressing part and the snap-fitting part; and an elastic component, configured to provide a snap-fitting force for the snap-fitting part; when the press locking portion is pressed downward to the locking position, the snap-fitting member is snap-fitted with snap-fitting part; and when the pressing part is subjected to the lateral pressing force, the fitting between the snap-fitting member and the snap-fitting part is released.

In some embodiments, the snap-fitting member is a hook, and the hook is configured to be capable of snap-fitting with a bottom end of the unlocking component.

In some embodiments, one end of the elastic component abuts against the snap-fitting part, and the other end of the elastic component abuts against the upper cover.

In some embodiments, the unlocking component is provided with a limiting portion, and the elastic component is in limiting fit with the limiting portion.

In some embodiments, a mounting hole is provided on an inner wall of the mounting recess, a rotating shaft is provided on the unlocking component, and the rotating shaft is rotatably fitted with the mounting hole.

In some embodiments, a guide groove is further provided on the inner wall of the mounting recess, and the guide groove extends from the mounting hole to a top wall of the upper cover along the axial direction of the container cover.

In some embodiments, the press locking portion includes a pressing cover, and the pressing cover is slidably arranged in the mounting recess; an accommodating cavity is formed between the pressing cover and the upper cover; a connecting rod is provided on the sealing cover, the connecting rod passes through a bottom wall of the upper cover and extends into the accommodating cavity; a lever is provided in the accommodating cavity, a fulcrum of the lever is located on the upper cover, a first end of the lever is hinged to the connecting rod, and a second end of the lever cooperates with the pressing cover; the sealing cover includes a flexible sealing portion, and the flexible sealing portion has a tapered structure gradually expanding in a direction towards the upper cover; the upper cover includes a protruding ring, and the protruding ring corresponds to the flexible sealing portion; when the press locking portion is pressed downwards, the second end of the lever is pressed downwards, the first end of the lever is lifted up to drive the sealing cover to move upwards, and the flexible sealing portion expands outwards under a squeezing effect of the protruding ring, such that press sealing is formed between the flexible sealing portion and an inner wall of the storage cavity of the container body.

In some embodiments, a number of levers is two, and the two levers are arranged symmetrically about a center of the press locking portion.

In some embodiments, the bottom wall of the upper cover is provided with a protruding post protruding upwards, the protruding post is internally provided with a guide hole, the pressing cover is provided with a guide rod, and the guide rod is slidably arranged in the guide hole; and/or the second end of the lever is of an L shape.

In some embodiments, a guide slope is formed on an outer wall of an end facing the flexible sealing portion of the protruding ring, and when the press locking portion is in an unlocking state, an outer edge of an end portion of a side of the flexible sealing portion facing the protruding ring is located on an outer side of an outer wall of the protruding ring.

In some embodiments, the protruding ring extends into the storage cavity, and a gap between the outer wall of the protruding ring and the inner wall of the storage cavity is less than a thickness of the flexible sealing portion.

In some embodiments, a return spring is provided between the upper cover and the sealing cover, a first end of the return spring abuts against the bottom wall of the upper cover, and a second end of the return spring abuts against the sealing cover.

In some embodiments, the sealing cover includes an inner cover, a support cover, and a flexible sealing portion, the inner cover is arranged in the support cover and is detachably connected with the support cover, and the flexible sealing portion is mounted on an outer periphery of the support cover; and/or both sides of the press locking portion are respectively provided with the lateral unlocking portion.

By applying some embodiments of the present disclosure, the storage container is provided with the press locking portion and the lateral unlocking portion, the closing of the storage container is achieved by pressing the press locking portion downwards, and the opening of the storage container is achieved by laterally pressing the lateral unlocking portion; in this way, in one aspect, a user is able to apply the lateral pressing force on the lateral unlocking portion by holding the lateral unlocking portion, and is able to easily remove the container cover by lifting the container cover while holding the lateral unlocking portion by hand, being convenient and time-saving, improving the user experience; in another aspect, closing and opening require different force application directions and different operation positions, and thus opening cannot be achieved by pressing the press locking portion multiple times; and the opening of the storage container is achieved by applying a force to the lateral unlocking portion laterally, and the position is not easily touched, and thus a problem of unlocking by unintended touch cannot easily occur, effectively avoiding opening of the container cover caused by unintended touch of the storage container, improving the usage reliability of the storage container; in still another aspect, by separately arranging the press locking portion and the lateral unlocking portion, unlocking by the user by pressing the press locking portion is able to be avoided, thereby avoiding a problem that the user's hand feels a counter-pushing force due to the press locking portion springing up, further improving the user experience.

BRIEF DESCRIPTION OF THE DRAWINGS

The drawings constituting a part of the present disclosure are intended to provide better understanding of the present disclosure, and the schematic embodiments of the present disclosure and the description thereof are used to explain the present disclosure, but not to limit the present disclosure improperly. In the drawings.

Figure 1:
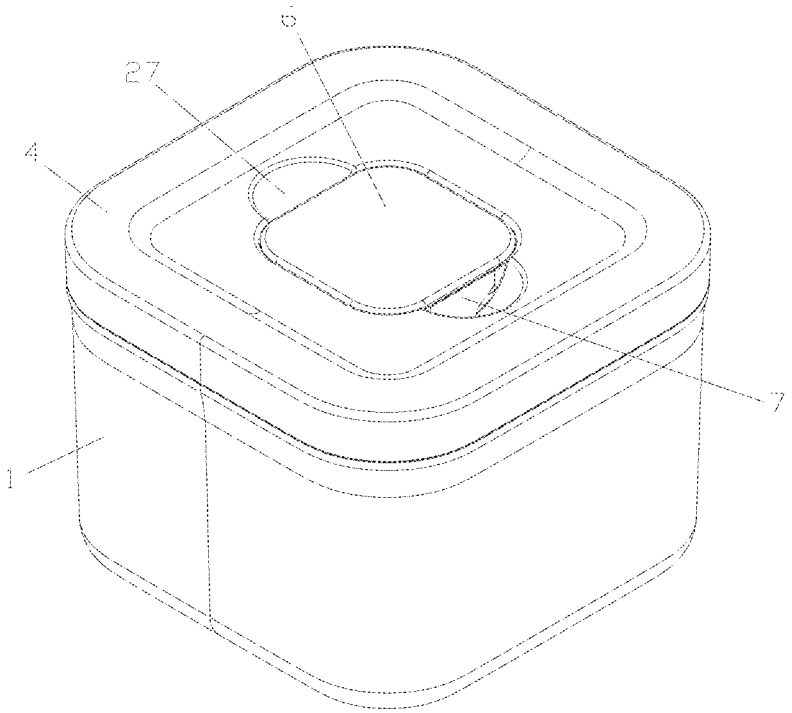
FIG. 1 is a schematic diagram of the three-dimensional structure of a storage container according to embodiment I of the present disclosure.
Figure 2:
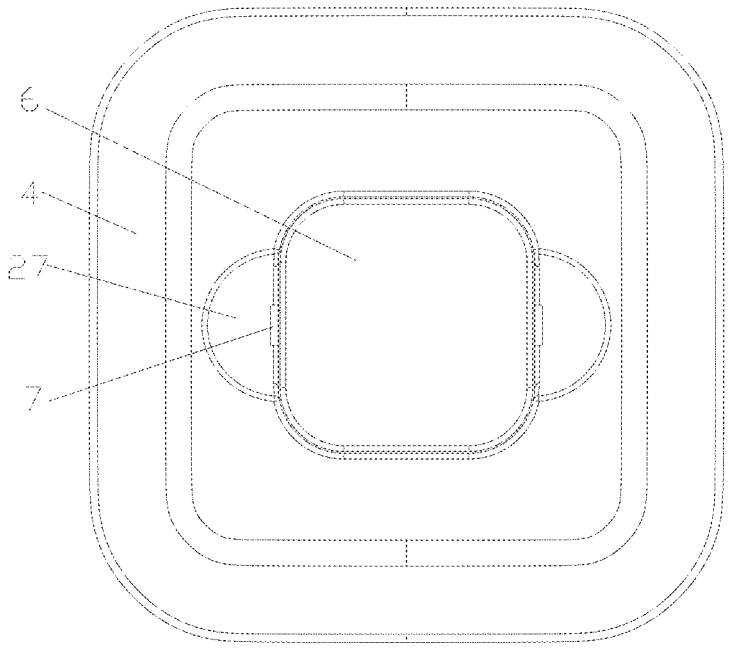
FIG. 2 is a schematic diagram of the top view structure of a storage container according to embodiment I of the present disclosure.
Figure 3:
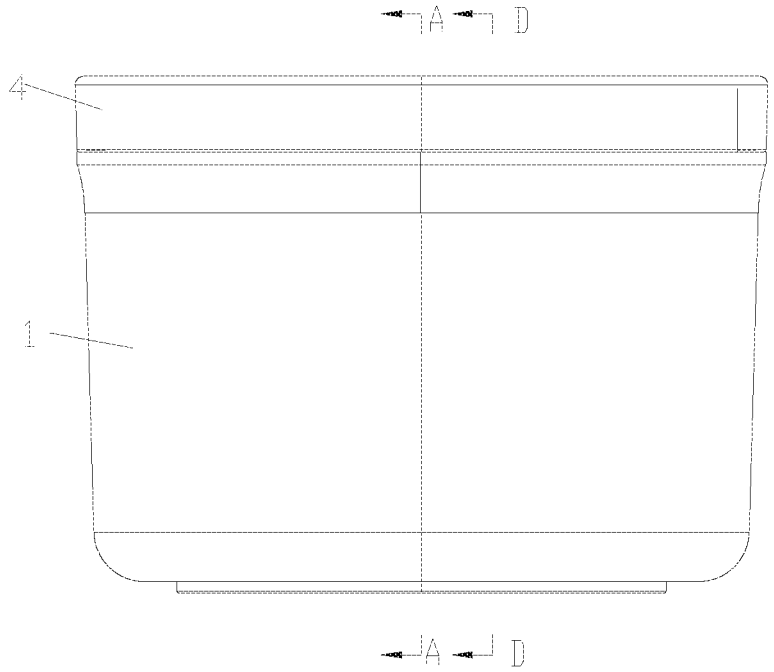
FIG. 3 is a schematic diagram of the front view structure of a storage container according to embodiment I of the present disclosure.
Figure 4:
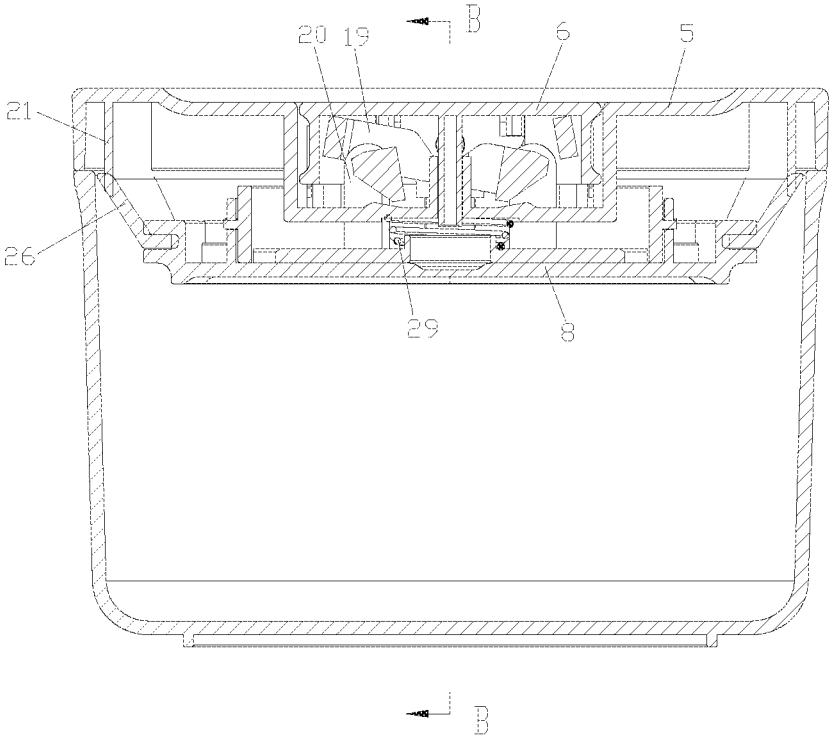
FIG. 4 is a schematic diagram of the section view structure in the A-A direction of FIG. 3.
Figure 5:
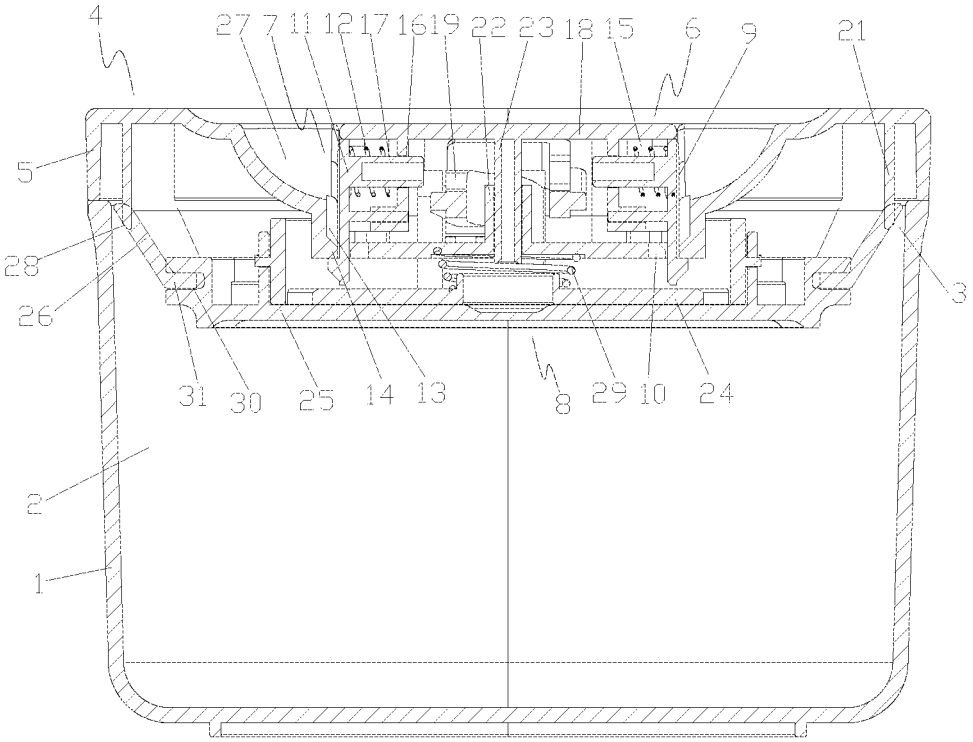
FIG. 5 is a schematic diagram of the sectional view structure in the B-B direction of FIG. 4.
Figure 6:
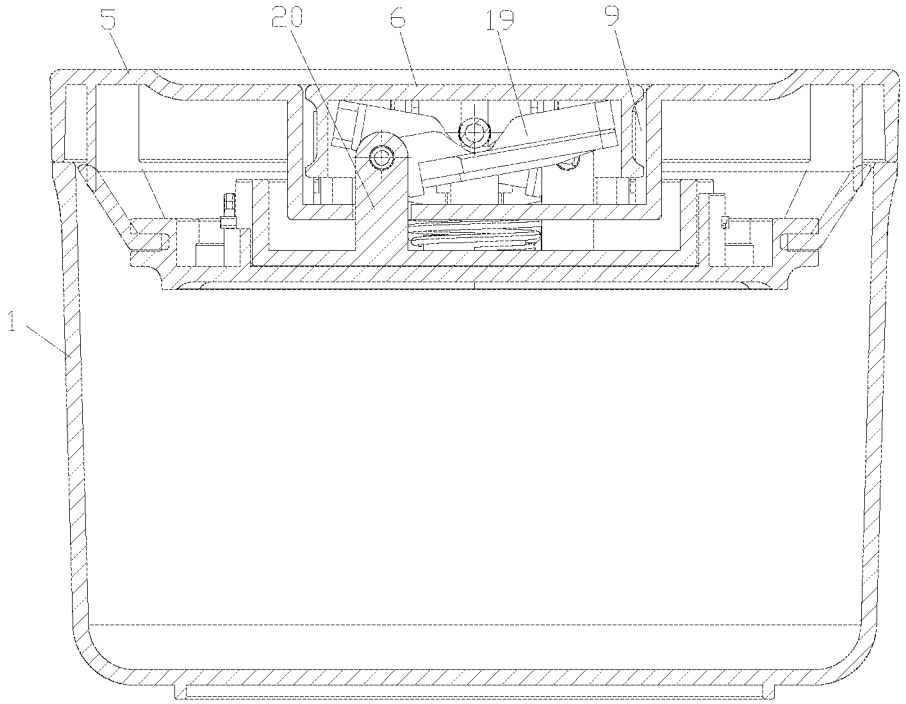
FIG. 6 is a schematic diagram of the sectional view structure in the D-D direction of FIG. 3.
Figure 7:
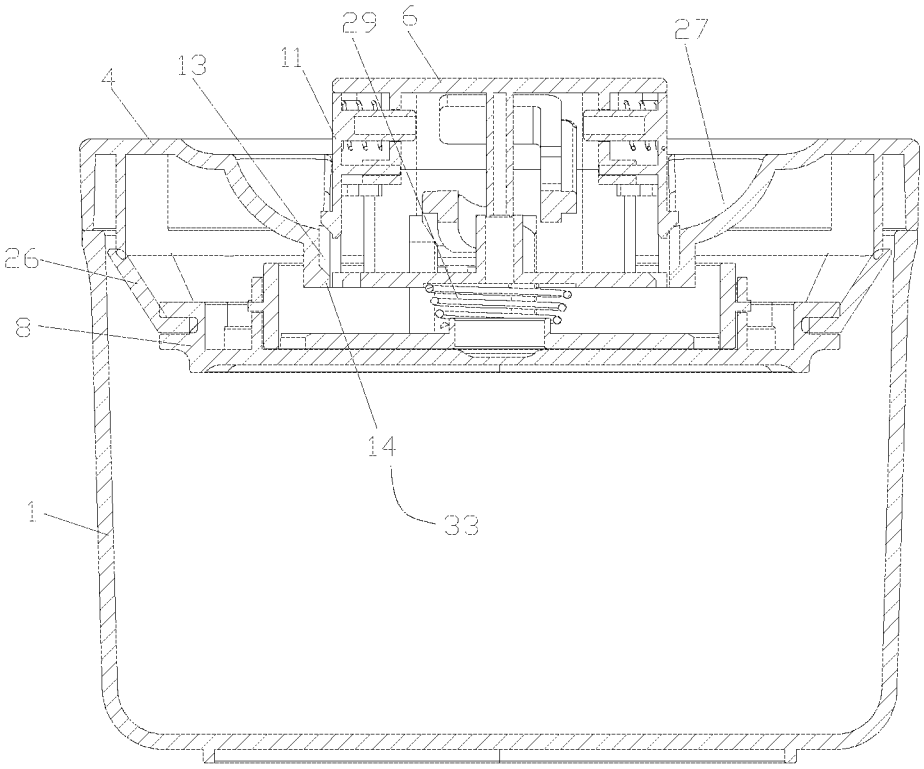
FIG. 7 is a sectional view structural diagram of a storage container of embodiment I of the present disclosure in an open state.
Figure 8:
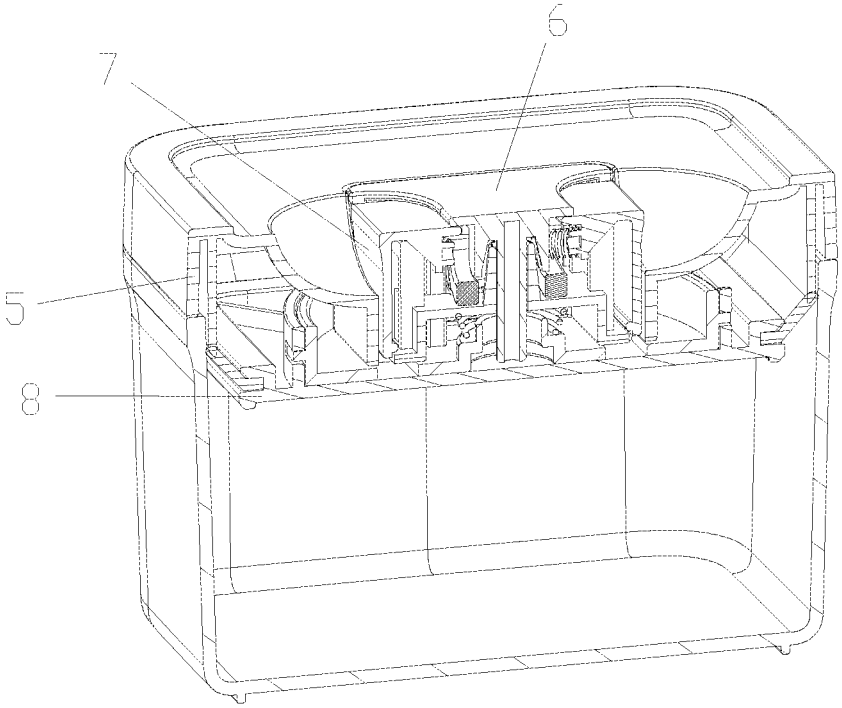
FIG. 8 is a sectional view of a storage container of embodiment II of the present disclosure at one angle.
Figure 9:
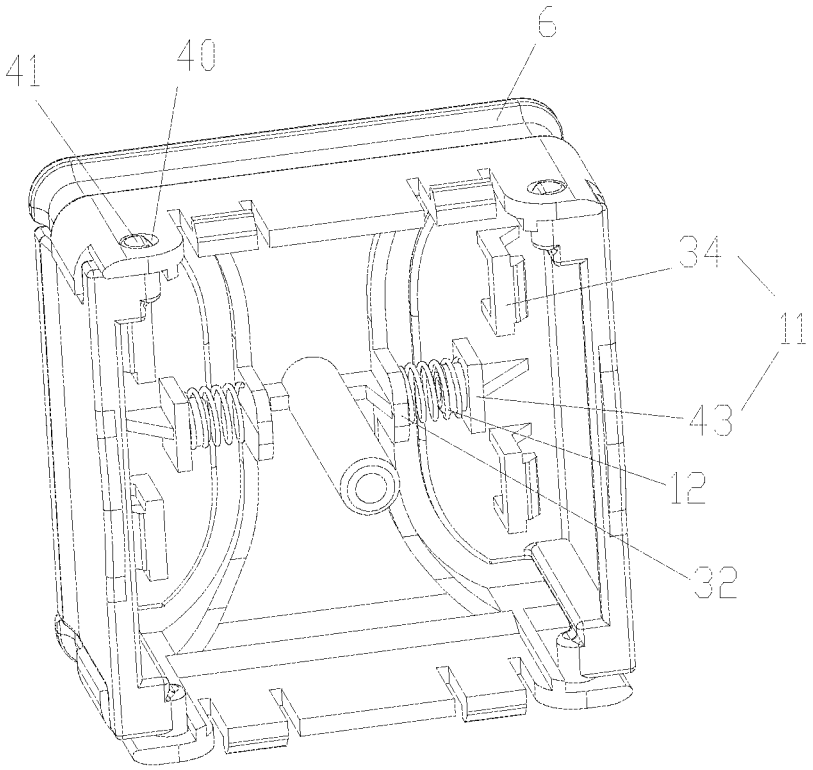
FIG. 9 is a schematic diagram of a part of the structure of a storage container of embodiment II of the present disclosure.
Figure 10:
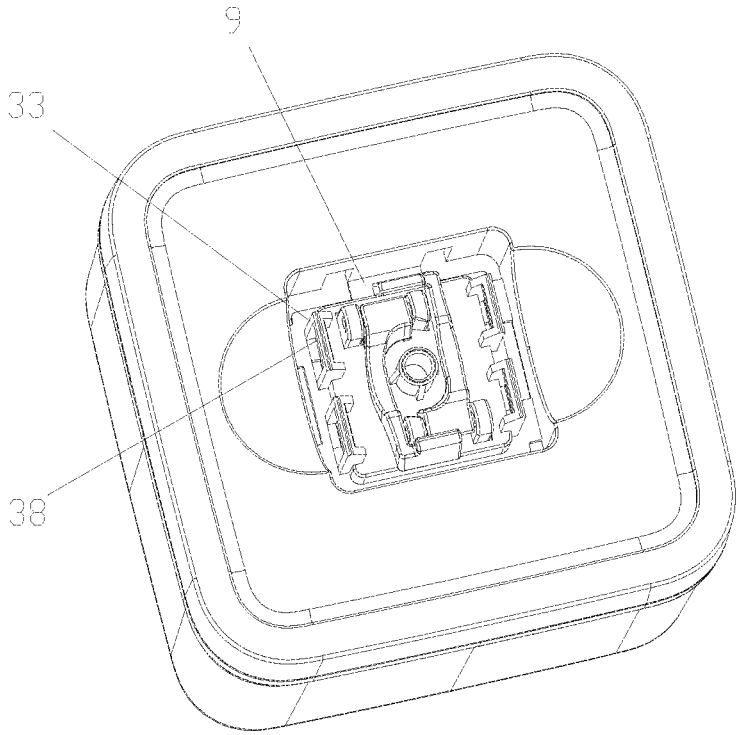
FIG. 10 is a schematic diagram of a part of the structure of a storage container of embodiment II of the present disclosure.
Figure 11:
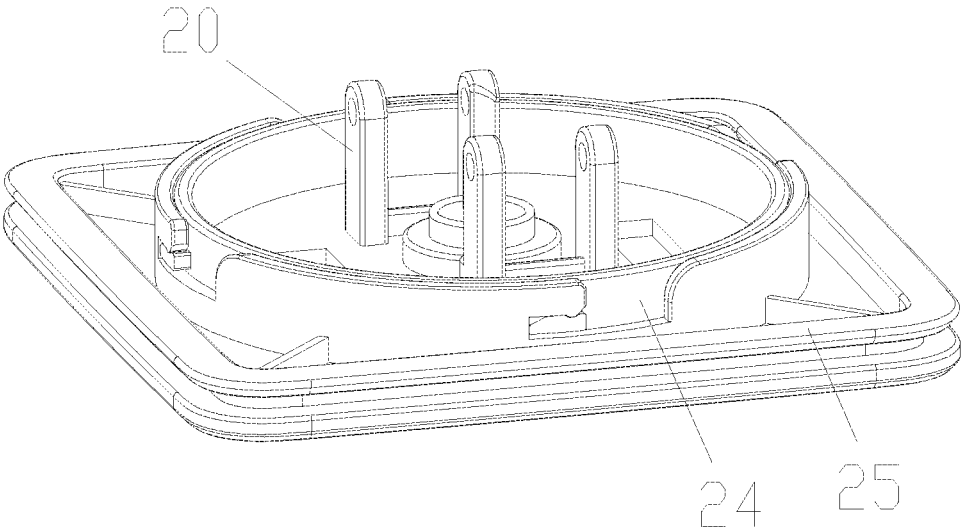
FIG. 11 is a schematic diagram of a part of the structure of a storage container of embodiment II of the present disclosure.
Figure 12:
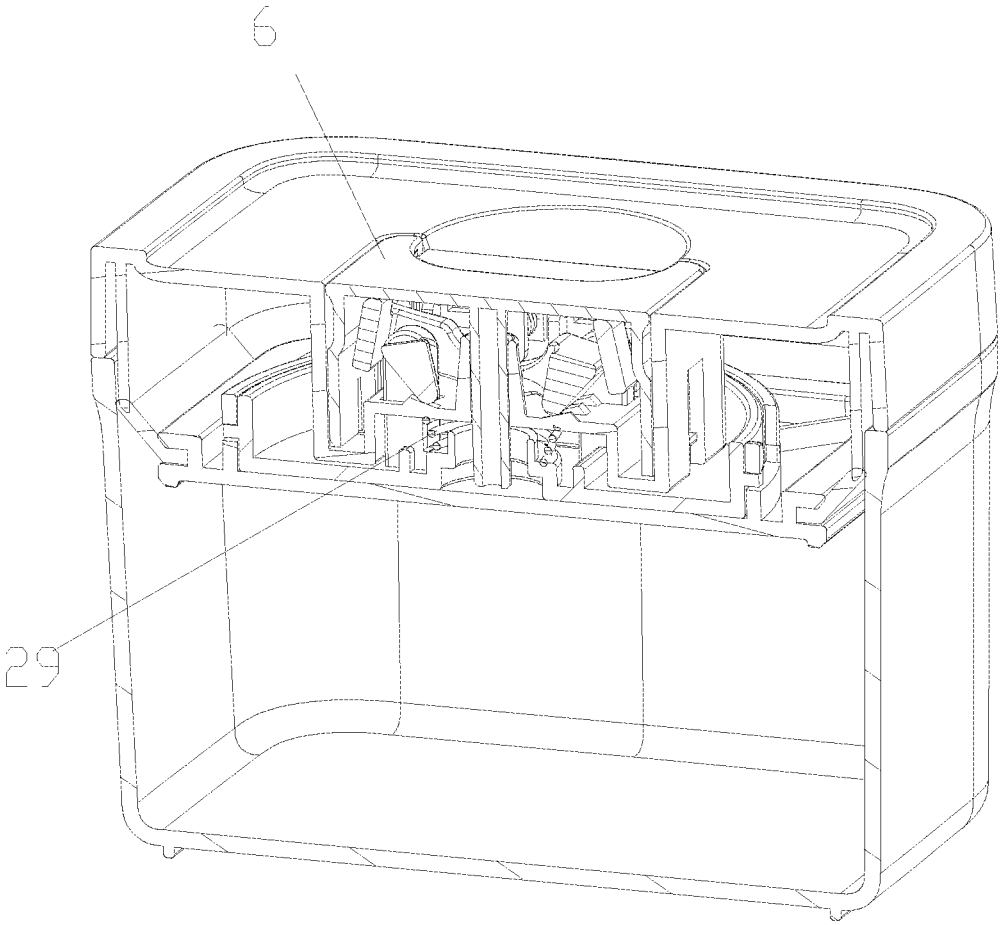
FIG. 12 is a sectional view of a storage container of embodiment II of the present disclosure at another angle.
Figure 13:
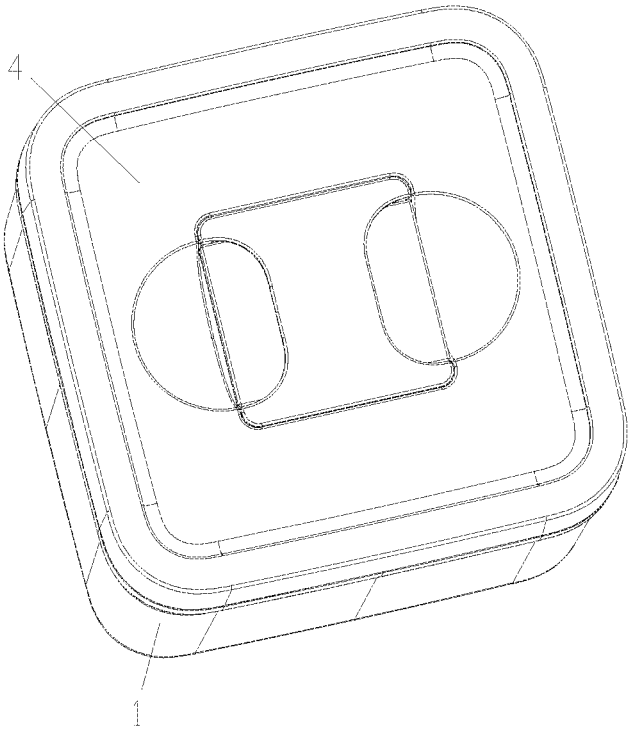
FIG. 13 is a structural schematic diagram of a storage container of embodiment II of the present disclosure.
Figure 14:
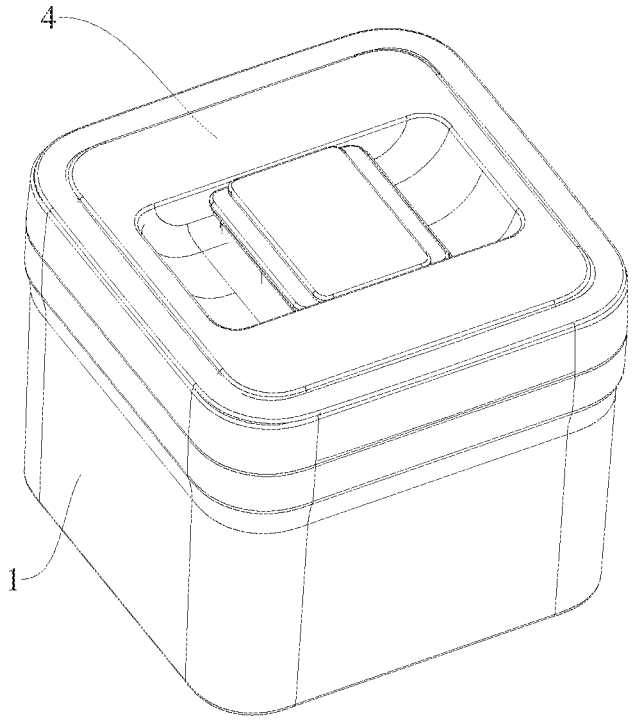
FIG. 14 is a structural schematic diagram of a storage container of embodiment III of the present disclosure.
Figure 15:
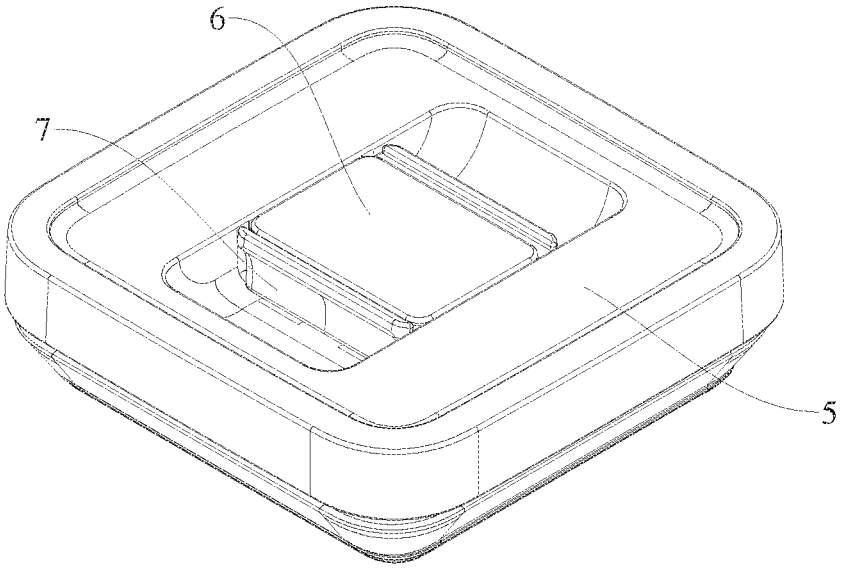
FIG. 15 is a structural schematic diagram of a container cover of the storage container of FIG. 14.
Figure 16:
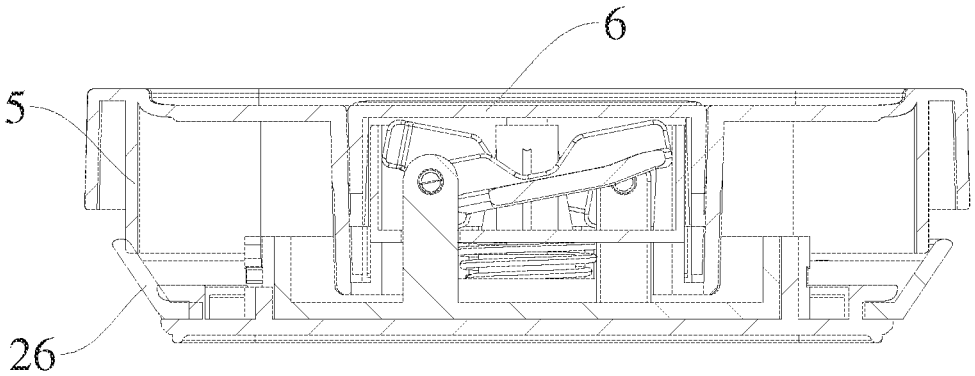
FIG. 16 is a sectional view of the container cover of FIG. 15 at one angle.
Figure 17:
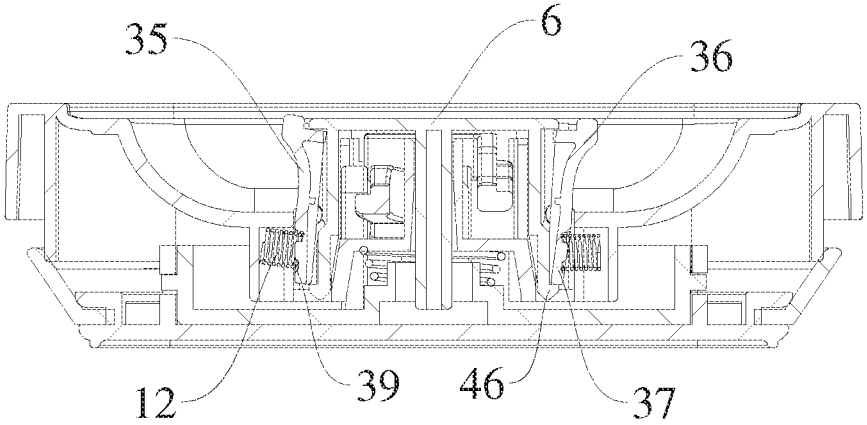
FIG. 17 is a sectional view of the container cover of FIG. 15 at another angle.

The drawings contain the following reference signs:

1. container body; 2. storage cavity; 3. opening; 4. container cover; 5. upper cover; 6. press locking portion; 7. lateral unlocking portion; 8. sealing cover; 9. mounting recess; 10. operating groove; 11. second snap-fitting component; 12. elastic component; 13. avoidance groove; 14. stop portion; 15. accommodating groove; 16. guide hole; 17. guide post; 18. pressing cover; 19. lever; 20. connecting rod; 21. protruding ring; 22. protruding post; 23. guide rod; 24. inner cover; 25. support cover; 26: flexible sealing portion; 27. grip point; 28. guide slope; 29. return spring; 30. ring-shaped snap groove; 31. inner ring flange; 32. second stop portion; 33. first snap-fitting component; 34. hook member; 35. unlocking component; 36. pressing part; 37. snap-fitting part; 38. snap groove; 39. limiting portion; 40. mounting hole; 41. rotating shaft; 42. guide groove; 43. stop member; 44. hook structure; 45. slide groove; 46: snap-fitting member.

DETAILED DESCRIPTION OF THE EMBODIMENTS

It should be noted that, without conflict, the embodiments and the features of embodiments of the present application is able to be combined. The embodiments of the present disclosure are described in detail with reference to the drawings combined with the embodiments.

Embodiment I

As shown in FIGS. 1-7, embodiment I of the present disclosure provides a storage container. The storage container includes: a container body 1, provided with a storage cavity 2 and an opening 3 in communication with the storage cavity 2; and a container cover 4, covering the opening 3 of the container body 1, the container cover 4 including an upper cover 5, a press locking portion 6, a lateral unlocking portion 7, and a sealing cover 8, the upper cover 5 being provided with a mounting recess 9, the press locking portion 6 being movably arranged in the mounting recess 9, the lateral unlocking portion 7 being arranged on a side portion of the press locking portion 6, and the sealing cover 8 being located in the storage cavity 2 and linked to the press locking portion 6; when the press locking portion 6 is pressed downwards to a locking position, the sealing cover 8 closes the opening 3; and when subjected to a lateral pressing force, the lateral unlocking portion 7 unlocks the press locking portion 6, and the sealing cover 8 opens the opening 3.

In this technical solution, the storage container is provided with the press locking portion 6 and lateral unlocking portion 7, the closing of the storage container is achieved by pressing the press locking portion 6 downwards, and the opening of the storage container is achieved by laterally pressing the lateral unlocking portion 7; in this way, in one aspect, a user is able to apply the lateral pressing force to the lateral unlocking portion 7 by holding the lateral unlocking portion 7, and is able to easily remove the container cover 4 by lifting the container cover while holding the lateral unlocking portion 7 by hand, being convenient and time-saving, improving the user experience; in another aspect, closing and opening require different force application directions and different operation positions, and thus opening cannot be achieved by pressing the press locking portion 6 multiple times; and the opening of the storage container is achieved by applying a force to the lateral unlocking portion 7 laterally, and the position is not easily touched, and thus a problem of unlocking by unintended touch cannot easily occur, effectively avoiding opening of the container cover by unintended touch of the storage container, improving the usage reliability of the storage container; in still another aspect, by separately arranging the press locking portion 6 and the lateral unlocking portion 7, unlocking by a user by pressing the press locking portion 6 is able to be avoided, thereby avoiding a problem that the user's hand feels a counter-pushing force due to the press locking portion springing up, further improving the user experience.

In embodiment I, the opening and closing of the storage container are achieved by the sealing cover 8; as the press locking portion 6 and the sealing cover 8 are linked to each other, downward pressing of the press locking portion 6 actuates the sealing cover 8, such that a shape or a position of the sealing cover 8 changes; when the press locking portion 6 is pressed in place, the shape or the position of the sealing cover 8 is changed sufficiently to form a closed fit between the sealing cover 8 and an inner wall of the storage cavity 2 of the container body 1, thereby achieving a closing operation of the storage container by the sealing cover 8, ensuring an effect of sealing between the container cover 4 and the container body 1. When unlocking is needed, the lateral unlocking portion 7 on a side surface is operated, such that the press locking portion 6 is able to be unlocked by the lateral unlocking portion 7, such that the press locking portion 6 is able to move to an unlocking position. During a process of the press locking portion 6 moving to the unlocking position, with a movement of the press locking portion 6, the shape or the position of the sealing cover 8 changes again, such that the sealing cover is separated from a closed contact with the storage cavity 2 of the container body 1, causing the sealing cover 8 to be in an open state; thus, the container cover 4 is able to be conveniently removed from the container body 1, achieving an opening operation.

In one embodiment of embodiment I, the upper cover 5 of the container cover 4 is provided with a grip point 27 close to the mounting recess 9, the grip point 27 is recessed downwards from a top surface of the upper cover 5, and the grip point 27 is arranged corresponding to the position of the lateral unlocking portion 7, such that the lateral unlocking portion 7 is partially exposed to a recessed space of the grip point 27, thereby facilitating an unlocking operation of the lateral unlocking portion 7. A provision of the grip point 27 is able to provide a force application position for the lateral unlocking portion 7, such that a user is able to operate the lateral unlocking portion 7 more conveniently, reducing a difficulty in operation of the lateral unlocking portion 7. As only a part of the lateral unlocking portion 7 is located at the grip point 27, other part is still blocked by an inner wall of the mounting recess 9, preventing the lateral unlocking portion 7 from being separated from a side surface of the press locking portion 6, improving a structural stability of the lateral unlocking portion 7 and the reliability during operation.

As shown in FIGS. 1 to 7, in embodiment I of the present disclosure, the press locking portion 6 is pressed, the press locking portion 6 and the lateral unlocking portion 7 move together to the locking position, the lateral unlocking portion 7 is in locking fit with the upper cover 5; and when the lateral unlocking portion 7 is subjected to the lateral pressing force, the lateral unlocking portion 7 and the upper cover 5 are unlocked, so as to unlock the press locking portion 6.

By the described arrangement, the press locking portion 6 is pressed, such that the press locking portion 6 and the lateral unlocking portion 7 move together to the locking position, and the upper cover 5 locks the lateral unlocking portion 7 so as to lock the press locking portion 6, such that the sealing cover 8 is maintained in a closed state under a driving effect of the press locking portion 6; by pressing the lateral unlocking portion 7, the upper cover 5 is able to unlock the lateral unlocking portion 7, so as to unlock the press locking portion 6, such that the press locking portion 6 is able to reach the unlocking position, and the sealing cover 8 is in an open state under the driving effect of the press locking portion 6. In this way, in one aspect, a user is able to apply a lateral pressing force to the lateral unlocking portion 7 by holding the lateral unlocking portion 7, and is able to easily remove the container cover 4 by lifting the container cover while holding the lateral unlocking portion 7 by hand, being convenient and time-saving, improving the user experience; in another aspect, closing and opening require different force application directions and different operation positions, and thus opening cannot be achieved by pressing the press locking portion 6 multiple times; and the opening of the storage container is achieved by applying a force to the lateral unlocking portion 7 laterally, and the position is not easily touched, and thus the problem of unlocking by unintended touch cannot easily occur, effectively avoiding opening of the container cover by unintended touch of the storage container, improving the usage reliability of the storage container; in still another aspect, by separately arranging the press locking portion 6 and the lateral unlocking portion 7, unlocking by the user by pressing the press locking portion 6 is able to be avoided, thereby avoiding the problem that the user's hand feels a counter-pushing force due to the press locking portion springing up, further improving the user experience.

As shown in FIGS. 1-7, in embodiment I of the present disclosure, a first snap-fitting component 33 is provided on the upper cover 5, the lateral unlocking portion 7 includes a second snap-fitting component 11 and an elastic component 12; the second snap-fitting component 11 is arranged on a side portion of the press locking portion 6, the elastic component 12 is arranged between the second snap-fitting component 11 and the press locking portion 6, and provides an elastic locking force to the second snap-fitting component 11; when the press locking portion 6 is pressed downwards, the second snap-fitting component 11 is able to be snap-fitted with the first snap-fitting component 33; and when the lateral unlocking portion 7 is pressed, the second snap-fitting component 11 is able to be separated from the first snap-fitting component 33, and the press locking portion 6 is able to drive the sealing cover 8 to open the opening 3.

In embodiment I, the press locking portion 6 is pressed downwards, and under the effect of the elastic locking force of the elastic component 12, the second snap-fitting component 11 is able to be snap-fitted with the first snap-fitting component 33, causing the press locking portion 6 to be locked on the upper cover 5, and the sealing cover 8 is also maintained in a closed state under a driving effect of the press locking portion 6; by pressing the lateral unlocking portion 7, the second snap-fitting component 11 and the first snap-fitting component 33 are able to be successfully unlocked against the elastic locking force of the elastic component 12, such that the press locking portion 6 is able to reach the unlocking position, and the sealing cover 8 is in an open state under the driving effect of the press locking portion 6; and in this case, the container cover 4 is able to be conveniently removed from the container body 1.

As shown in FIGS. 1 to 7, in embodiment I of the present disclosure, an operating groove 10 is formed on a bottom wall of the upper cover 5, and the second snap-fitting component 11 is a hook; when the press locking portion 6 is pressed downwards, the hook is able to pass through the operating groove 10, and hook the bottom wall of the upper cover 5 under an elastic locking acting force of the elastic component 12; and when the lateral unlocking portion 7 is pressed, the hook is able to be separated from the bottom wall of the upper cover 5 and reach an avoidance area of the operating groove 10, and the press locking portion 6 is able to drive the hook to be separated from the operating groove 10.

In embodiment I, an operating groove 10 is provided at the bottom of the upper cover 5 to provide a passage for the hook; in a downward moving process of the press locking portion 6, a hook body of the hook is able to pass through the operating groove 10 and reach a bottom surface side of the bottom of the upper cover 5; when the hook body of the hook enters the operating groove 10, under a pressing effect of a side wall of the operating groove 10, the hook retracts towards an inner side of the press locking portion 6 against an elastic force of the elastic component 12, such that the hook is able to successfully pass through the operating groove 10; and once the hook body of the hook passes through the operating groove 10, as the effect of pressing between the hook body of the hook and the side wall of the operating groove 10 is removed, the hook extends towards an outer side of the press locking portion 6 under the elastic effect of elastic component 12, and the hook body of the hook moves to a lower side of the bottom wall of the upper cover 5, and is stopped by the bottom wall of the upper cover 5, such that the press locking portion 6 is locked on the upper cover 5, and the sealing cover 8 is also maintained in a closed state under the driving effect of the press locking portion 6.

When unlocking is needed, by pressing the lateral unlocking portion 7, the hook is able to be retracted, and the hook body of the hook is completely within a coverage range of the operating groove 10; in this case, an unlocking force is able to be applied to the press locking portion 6, so as cause the press locking portion 6 to move upward; as the hook body of the hook is located within the coverage range of the operating groove 10, the bottom wall of the upper cover 5 does not block a movement of the hook body of the hook, and the hook body of the hook is able to pass through the operating groove 10, such that the hook and the upper cover 5 is able to be successfully unlocked; when the hook and the upper cover 5 are unlocked, the press locking portion 6 is able to reach the unlocking position successfully, and the sealing cover 8 is in an open state under the driving effect of the press locking portion 6; and in this case, the container cover 4 is able to be conveniently removed from the container body 1.

In embodiment I, the hook body of the hook protrudes towards the outer side of the press locking portion 6, such that an extending direction of the hook body is opposite to a pressing direction of the lateral unlocking portion 7, facilitating an unlocking operation of the press locking portion 6 by a lateral pressing of the lateral unlocking portion 7. A dimension of the operating groove 10 is adapted to a dimension of a maximum cross section of the hook body, such that the locking and unlocking operations of the hook body of the hook are able to be successfully achieved while ensuring a structural strength of the bottom wall of the upper cover 5.

The elastic component 12 is, for example, a spring, and may be replaced with components having an elastic function such as an elastic block.

As shown in FIGS. 1 to 7, in embodiment I of the present disclosure, a side wall of the mounting recess 9 is provided with an avoidance groove 13, a bottom of the avoidance groove 13 is provided with a first stop portion 14, and the hook hooks a bottom wall of the first stop portion 14 once passing through the operating groove 10.

In embodiment I, by providing the avoidance groove 13, the hook body of the hook is able to be located in the avoidance groove 13 when located in the mounting recess 9, avoiding a large squeezing force on the hook body formed by the inner wall of the mounting recess 9, reducing a compression force applied by the hook to the elastic component 12 when the hook body is located in the mounting recess 9, reducing a compressing effect of the elastic component 12 when the press locking portion 6 is in a non-locking state, and prolonging a service life of the elastic component 12. The avoidance groove 13 extends to a bottom of the mounting recess 9; however, a bottom wall of the mounting recess 9 enables the bottom wall of the mounting recess 9 at a tail end of the avoidance grooves 13 to form the first stop portion 14, and once passing through the operating groove 10, the hook body of the hook is able to perform hooking by the first stop portion 14.

It should be noted that, in embodiment I of the present disclosure, the first stop portion 14 forms the first snap-fitting component 33.

As shown in FIGS. 1-7, in embodiment I of the present disclosure, a side wall the press locking portion 6 is provided with an accommodating groove 15, a guide hole 16 is provided on a bottom wall of the accommodating groove 15, a guide post 17 is provided on a side of the hook facing the accommodating groove 15, the guide post 17 is slidably arranged in the guide hole 16, the elastic component 12 is sleeved on the guide post 17, and a first end of the elastic component 12 abuts against the hook, and a second end of the elastic component 12 abuts against the bottom wall of the accommodating groove 15.

In embodiment I, by providing the accommodating groove 15, an accommodating space is able to be provided for an arrangement of the hook, such that the hook does not protrude from the press locking portion 6 in a lateral direction, and the hook and the press locking portion 6 are able to well form an integral whole, providing better appearance performance. By providing the guide post 17 on the hook and providing the guide hole 16 on the bottom wall of the accommodating groove 15, a lateral movement of the hook is able to be guided using a guide fit between the guide post 17 and the guide hole 16, achieving the reliability of the lateral movement of the hook, and more conveniently achieving a pressing operation of the lateral unlocking portion 7. The bottom wall of the accommodating groove 15 refers to a wall of a bottom of the accommodating groove 15. In embodiment I, the bottom wall of the accommodating groove 15 is a vertical wall and is perpendicular to an extending direction of the guide post 17.

As shown in FIGS. 1 to 7, in embodiment I of the present disclosure, the press locking portion 6 includes a pressing cover 18, and the pressing cover 18 is slidably provided in the mounting recess 9; an accommodating cavity is formed between the pressing cover 18 and the upper cover 5; a connecting rod 20 is provided on the sealing cover 8; the connecting rod 20 passes through the bottom wall of the upper cover 5 and extends into the accommodating cavity; a lever 19 is provided in the accommodating cavity, a fulcrum of the lever 19 is located on the upper cover 5, a first end of the lever 19 is hinged to the connecting rod 20, and a second end of the lever 19 cooperates with the pressing cover 18; the sealing cover 8 includes a flexible sealing portion 26, and the flexible sealing portion 26 has a tapered structure gradually expanding in a direction towards the upper cover 5; the upper cover 5 includes a protruding ring 21, and the protruding ring 21 is arranged corresponding to the flexible sealing portion 26; and when the locking portion 6 is pressed downwards, the second end of the lever 19 is pressed downwards, the first end of the lever 19 is lifted up to drive the sealing cover 8 to move upwards, and the flexible sealing portion 26 expands outwards under a squeezing effect of the protruding ring 21, such that press sealing is formed between the flexible sealing portion and the inner wall of the storage cavity 2 of the container body 1.

In embodiment I, the press locking portion 6 and the sealing cover 8 are linked to each other by the lever 19, the lever 19 is provided on the bottom wall of the upper cover 5 by the fulcrum, the second end of the lever 19 cooperating with the pressing cover 18 is lifted up, and the first end connected with the connecting rod 20 is lowered. When the press locking portion 6 is pressed downwards, the pressing cover 18 presses the lever 19 downwards, and the second end of the lever 19 is pressed downwards to drive the first end of the lever 19 to be lifted up; the connecting rod 20 moves upwards under a driving effect of the lever 19 to drive the sealing cover 8 to move upwards; in an upward moving process of the sealing cover 8, the flexible sealing portion 26 expands outwards under the squeezing effect of the protruding ring 21, and is pressed against the inner wall of the storage cavity of the container body 1 to form press sealing, thereby closing the storage container. Once the press locking portion 6 is unlocked, the press locking portion 6 is able to be controlled to move upwards, and in this case, an acting force for pressing the lever 19 downwards is removed, an acting force for lifting the sealing cover 8 up is removed, and the sealing cover 8 is able to move downwards under the effect of the lever 19 or an external force so as to be separated from a squeezing range of the protruding ring 21, thereby releasing an effect of squeeze sealing between the sealing cover and the container body 1; and in this case, the sealing cover 8 retracts inwards to be released from a contact with the container body 1, or a pressing acting force between the sealing cover 8 and the container body 1 is greatly reduced, and a friction force between the two is greatly reduced, facilitating the opening operation.

In one embodiment, an end of the lever 19 is hinged to a bottom wall of the pressing cover 18, and the fulcrum of the lever 19 is hinged to the bottom wall of the upper cover 5; in order to facilitate the arrangement of the lever 19 and avoid blocking of a rotation of the lever 19 caused by the bottom wall of the upper cover 5, a vertical post is able to be provided on the bottom wall of the pressing cover 18, and the fulcrum of the lever 19 is hinged to the vertical post, providing sufficient space for the rotation of the lever 19.

In one embodiment, a support block is also able to be provided on the bottom wall of the pressing cover 18, a top of the support block is arc-shaped, the first end of the lever 19 is hinged to the connecting rod 20, a middle of the lever 19 is supported on the top of the support block, and the second end of the lever 19 is suspended.

As shown in FIGS. 1-7, in embodiment I of the present disclosure, a number of lever 19 is two, and the two levers 19 are symmetrically arranged about a center of the press locking portion 6.

In embodiment I, the two levers 19 are arranged symmetrically about the center of the press locking portion 6, such that a lifting-up force of the levers 19 on the sealing cover 8 during pressing is more balanced, and the structure is more stable.

As shown in FIGS. 1 to 7, in embodiment I of the present disclosure, the bottom wall of the upper cover 5 is provided with a protruding post 22 protruding upwards, the protruding post 22 is internally provided with a guide hole 16, the pressing cover 18 is provided with a guide rod 23, and the guide rod 23 is slidably arranged in the guide hole 16.

In embodiment I, the protruding post 22 is provided on the bottom wall of the upper cover 5, the protruding post 22 is provided with the guide hole 16, the guide hole 16 extends in the pressing direction of the press locking portion 6, the guide rod 23 is provided on the pressing cover 18, and the guide rod 23 is slidably fitted with the guide hole 16, such that the press locking portion 6 is able to be controlled to slide along the guiding direction of the guide hole 16, improving the stability and reliability of the movement direction of the press locking portion 6.

As shown in FIGS. 1-7, in embodiment I of the present disclosure, the second end of the lever 19 is of an L shape. Configuring the second end of the lever 19 cooperating with the pressing cover 18 to be of an L shape is able to increase a contact area between the lever 19 and the pressing cover 18, improving the stability of a structure of cooperation between the lever 19 and the pressing cover 18. In addition, due to the L-shaped structure, during a process of pressing the pressing cover 18, a force bearing structure of the lever 19 is more balanced, and the force applied by the pressing cover 18 to the lever 19 is more uniform.

As shown in FIGS. 1-7, in embodiment I of the present disclosure, a guide slope 28 is provided on an outer wall of an end facing the flexible sealing portion 26 of the protruding ring 21; and when the press locking portion 6 is in an unlocking state, an outer edge of an end portion of a side of the flexible sealing portion 26 facing the protruding ring 21 is located on an outer side of an outer wall of the protruding ring 21.

In embodiment I, by forming the guide slope 28 on the outer edge of the end facing the flexible sealing portion 26 of the protruding ring 21, when the flexible sealing portion 26 moves towards the protruding ring 21, the guide slope 28 is able to be used to guide a movement of the flexible sealing portion 26, guiding the flexible sealing portion 26 to expand outwards under an effect of the guide slope 28 to squeeze and seal the inner wall of the storage cavity 2 of the container body 1. The guide slope 28 of the protruding ring 21 is able to reduce the difficulty in the movement of the flexible sealing portion 26 towards the protruding ring 21 and expanding, avoiding an interference in the process of the flexible sealing portion 26 moving relative to the protruding ring 21, improving the reliability of the movement.

In one embodiment, an inner wall surface of an end of the flexible sealing portion 26 facing the protruded ring 21 is also provided with a guide slope, thereby further reducing the difficulty in fitting between the flexible sealing portion 26 and the protruding ring 21.

As shown in FIGS. 1-7, in embodiment I of the present disclosure, the protruding ring 21 extends into the storage cavity 2, and a gap between the outer wall of the protruding ring 21 and the inner wall of the storage cavity 2 is less than a thickness of the flexible sealing portion 26.

In embodiment I, as the protruding ring 21 extends into the storage cavity 2, when the flexible sealing portion 26 is sleeved on an outer periphery of the protruding ring 21 and expands outwards under a support effect of the protruding ring 21, a portion crossing a bottom surface of the protruding ring 21 enters the gap between the outer wall of the protruding ring 21 and the inner wall of the storage cavity 2; the gap between the outer wall of the protruding ring 21 and the inner wall of the storage cavity 2 is less than the thickness of the flexible sealing portion 26, and thus the flexible sealing portion 26 entering the gap will deform due to the pressing force between the outer wall of the protruding ring 21 and the inner wall of the storage cavity 2, thereby pressing against the inner wall of the storage cavity 2; and press sealing is formed between the flexible sealing portion and the inner wall of the storage cavity 2, achieving a good closing effect.

As shown in FIGS. 1 to 7, in embodiment I of the present disclosure, a return spring 29 is provided between the upper cover 5 and the sealing cover 8, a first end of the return spring 29 abuts against the bottom wall of the upper cover 5, and a second end of the return spring 29 abuts against the sealing cover 8.

In embodiment I, the second end of the lever 19 has a suspended structure, and has no direct connection relationship with the pressing cover 18; when the press locking portion 6 is in an unlocking state, the hook body of the hook is separated from the bottom wall of the upper cover 5 along the operating groove 10 so as to release the locking effect from the press locking portion 6; in this case, the sealing cover 8 is pressed downwards under the elastic force effect of the return spring 29, moving away from the upper cover 5; in this process, the connecting rod 20 is driven by the sealing cover 8 to move downwards, the first end of the lever 19 connected with the connecting rod 20 also moves downwards, and the second end of the lever 19 is lifted up and drives the pressing cover 18 to move upwards so as to reach the unlocking position, facilitating the automatic opening of the storage container.

As shown in FIGS. 1-7, in embodiment I of the present disclosure, the sealing cover 8 includes an inner cover 24, a support cover 25, and a flexible sealing portion 26, the inner cover 24 is arranged in the support cover 25 and is detachably connected with the support cover 25, and the flexible sealing portion 26 is mounted on an outer periphery of the support cover 25; and/or both sides of the press locking portion 6 are respectively provided with the lateral unlocking portion 7.

Specifically, in embodiment I of the present disclosure, the outer periphery of the support cover 25 is provided with a ring-shaped snap groove 30, the flexible sealing portion 26 includes an inner ring flange 31, and the inner ring flange 31 is snapped fitted into the ring-shaped snap groove 30, so as to connect the flexible sealing portion 26 with the support cover 25.

In embodiment I, the inner cover 24, the support cover 25 and the flexible sealing portion 26 are separated from one another, reducing the difficulty in forming each part. In addition, materials of the inner cover 24, the support cover 25, and the flexible sealing portion 26 are able to be selected more flexibly, facilitating selecting an appropriate material according to the characteristics of the sealing cover 8, improving the sealing performance of the sealing cover 8.

The inner cover 24 and the support cover 25 are able to be made of hard rubber, so as to play a role for stable support; the flexible sealing portion 26 is able to be made of soft rubber, such that the flexible sealing portion has a good deformation capability, and is able to be well fitted with the inner wall of the storage cavity 2 of the container body 1 by squeeze sealing.

In one embodiment, both sides of the press locking portion 6 are respectively provided with the lateral unlocking portion 7.

In embodiment I, both sides of the press locking portion 6 are respectively provided with the lateral unlocking portion 7, avoiding a problem of insufficient reliability caused by arranging the lateral unlocking portion 7 on a single side; when there is a need to unlock the press locking portion 6, the lateral unlocking portion 7 on two sides need to be pressed simultaneously to unlock the press locking portion 6, providing better stability and reliability for the whole structure of the storage container.

Figure 19:
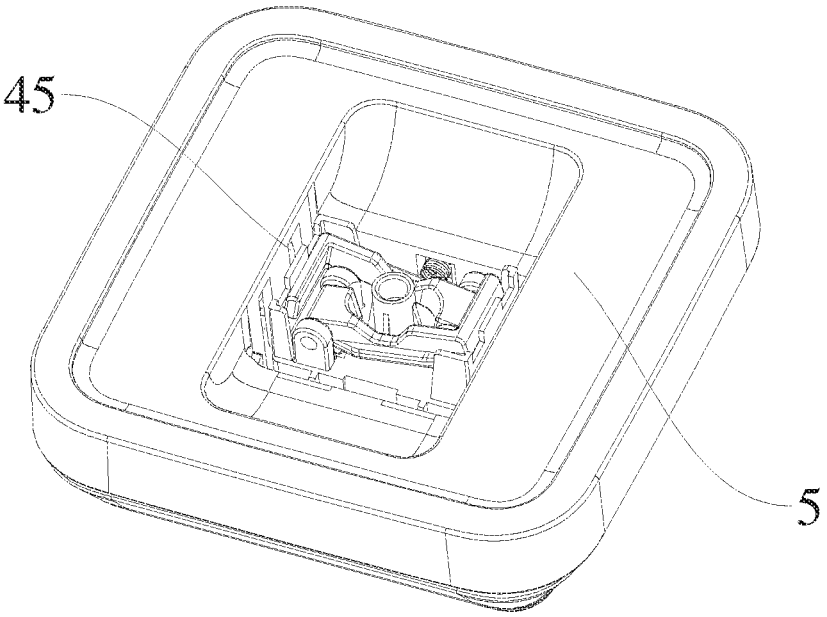
FIG. 19 is a structural schematic diagram of the container cover of FIG. 15 at another angle (in which a press locking portion is not shown)
Figure 20:
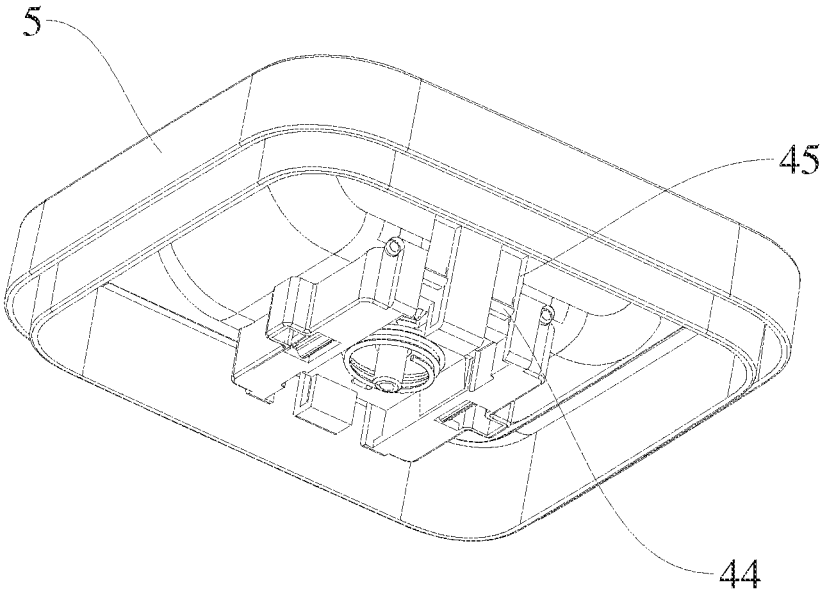
FIG. 20 is a bottom view of the container cover of FIG. 19.

As shown in FIGS. 19 and 20, in embodiment I of the present disclosure, the container cover for the storage container further includes a hook structure 44 connected with the press locking portion 6, a sliding groove 45 in communication with the mounting recess is further provided on the upper cover 5, and the hook structure 44 is snapped into the sliding groove 45 and slidably fitted with the sliding groove 45. In this way, during a movement process of the press locking portion 6, the sliding groove 45 is able to play a role for guiding, and the hook structure 44 is able to avoid the separation of the press locking portion 6 from the upper cover 5.

Embodiment II

As shown in FIGS. 8 to 13, embodiment II differs from embodiment I of the present disclosure in that: the first snap-fitting component 33 is connected to the bottom wall of the mounting recess 9, and the first snap-fitting component 33 extends towards a direction away from the sealing cover 8; the second snap-fitting component 11 is rotatably connected with the press locking portion 6, a second stop portion 32 is provided on a side of the press locking portion 6 facing the sealing cover 8, the second stop portion 32 extends towards a side where the sealing cover 8 is located, and the elastic component 12 is provided between the second snap-fitting component 11 and the second stop portion 32.

By the arrangement, the press locking portion 6 is pressed downwards, and the press locking portion 6 drives the second snap-fitting component 11 to be snap-fitted with the first snap-fitting component 33, so as to maintain, using the elastic component 12, the press locking portion 6 to be in a locking position; when there is a need to unlock the press locking portion 6, the second snap-fitting component 11 is able to be pressed laterally, such that the second snap-fitting component 11 rotates against the elastic force of the elastic component 12, such that the fitting between the first snap-fitting component 33 and the second snap-fitting component 11 is released, thereby causing the press locking portion 6 to switch from the locking position to the unlocking position.

As shown in FIGS. 8 to 13, in embodiment II of the present disclosure, one of the first snap-fitting component 33 and the second snap-fitting component 11 includes a hook member 34, the other of the first snap-fitting component 33 and the second snap-fitting component 11 is provided with a snap groove 38, and the hook member 34 is able to be snap-fitted with the snap groove 38 or separated from the snap groove 38. In this way, connection and separation between the first snap-fitting component 33 and the second snap-fitting component 11 are able to be achieved.

In embodiment II, an end surface of an end of the first snap-fitting component 33 away from the sealing cover 8 is a slope, and the slope extends obliquely from a side where the lateral unlocking portion 7 is located to the bottom of the mounting recess 9; the snap groove 38 is provided on the first snap-fitting component 33, and the snap groove 38 is located on a side of the slope close to the sealing cover 8; the second snap-fitting component 11 includes the hook member 34, and the second snap-fitting component 11 further includes a stop member 43 connected with the hook member 34; the stop member 43 is located on a side of the hook member 34 facing the second stop portion 32, and the elastic member 12 is located between the stop member 43 and the second stop portion 32. Moreover, the snap-fitting position between the hook member 34 and the snap groove 38 is located between the elastic component 12 and the pivot point between the second snap-fitting component 11 and the press locking portion 6.

When unlocking is needed, the hook member 34 is pressed to cause the hook member 34 to rotate relative to the press locking portion 6 towards a side where the elastic component 12 is located, such that the hook member 34 is able to be separated from the snap groove 38, achieving the unlocking operation of the press locking portion 6; when the press locking portion 6 successfully reaches the unlocking position, the sealing cover 8 is in the open state under the driving effect of the press locking portion 6; and in this case, the container cover 4 is able to be conveniently opened from the container body 1.

In the process of the press locking portion 6 moving towards the side where the sealing cover 8 is located, the hook member 34 first abuts against the slope, and as the hook member 34 continues to move towards the side where the sealing cover 8 is located, the hook member 34 rotates, under the pressing effect of the slope, towards a side close to the side where the elastic component 12 is located; in this case, the stop member 43 also moves towards the side where the elastic component 12 is located, the elastic component 12 is compressed; and when the hook member 34 moves to the position where the snap groove 38 is located, the hook member 34 is snapped into the snap groove 38, and due to the removal of the pressing effect between the hook member 34 and the slope, the hook member 34 is in locking fit with the snap groove 38 under the elastic effect of the elastic component 12, the press locking portion 6 is locked on the upper cover 5, and the storage container is in the closed state under the driving effect of the press locking portion 6.

The hook member 34 of embodiment II protrudes towards the outer side of the press locking portion 6, such that the extending direction of the hook member 34 is opposite to the pressing direction of the lateral unlocking portion 7, facilitating the unlocking operation of the press locking portion 6 by the lateral pressing of the lateral unlocking portion 7.

In embodiment II, the stop member 43 is arranged corresponding to the second stop portion 32, the stop member 43 and the second stop portion 32 each have a positioning post, the second stop portion 32 is located on an inner side of the stop member 43, one end of the elastic component 12 is sleeved on the positioning post of the stop member 43, and the other end of the elastic component 12 is sleeved on the positioning post of the second stop portion 32.

In one embodiment, both the second snap-fitting component 11 and the second stop portion 32 are stop plates.

As shown in FIGS. 8 to 13, in embodiment II of the present disclosure, a rotating shaft 41 is provided at an end of the hook member 34 close to the sealing cover 8, a mounting hole 40 is provided at an end of the press locking portion 6 close to the sealing cover 8, the mounting hole 40 is arranged corresponding to the rotating shaft 41, and the rotating shaft 41 passes through the mounting hole 40; and by this arrangement, the press locking portion 6 and the lateral unlocking portion 7 are rotatably connected.

Other structures of embodiment II are the same as those of embodiment I of the present disclosure, and are not repeated herein.

Embodiment III

As shown in FIGS. 14 to 20, embodiment III differs from embodiment I of the present disclosure in that: the press locking portion 6 is arranged movably relative to the lateral unlocking portion 7; when the press locking portion 6 is pressed to the locking position, the press locking portion 6 is in locking fit with the lateral unlocking portion 7; and when the lateral unlocking portion 7 is subjected to a lateral pressing force, the press locking portion 6 and the lateral unlocking portion 7 are unlocked.

With this arrangement, the press locking portion 6 is pressed to the locking position, such that the press locking portion 6 is locked by the lateral unlocking portion 7, and the upper cover 5 is able to abut against the flexible sealing portion 26, such that the flexible sealing portion 26 is able to expand outwards under a squeezing effect of the upper cover 5, such that the flexible sealing portion 26 and the container body are able to be sealed; when there is a need to retract the flexible sealing portion 26 inwards, that is, to release the sealing between the flexible sealing portion 26 and the container body, the lateral unlocking portion 7 is able to be pressed laterally to cause the lateral unlocking portion 7 to unlock the press locking portion 6; in this case, the upper cover 5 is able to be released from the contact with the flexible sealing portion 26, such that the flexible sealing portion 26 is released from the contact with the container body 1, facilitating the opening operation. In this way, in one aspect, a user is able to apply the lateral pressing force to the lateral unlocking portion 7 by holding the lateral unlocking portion 7, and is able to easily remove the container cover 4 by lifting the container cover while holding the lateral unlocking portion 7 by hand, being convenient and time-saving, improving the user experience; in another aspect, closing and opening require different force application directions and different operation positions, and thus opening cannot be achieved by pressing the press locking portion 6 multiple times; and the opening of the storage container is achieved by applying a force to the lateral unlocking portion 7 laterally, and the position is not easily touched, and thus the problem of unlocking by unintended touch cannot easily occur, effectively avoiding opening of the container cover by unintended touch of the storage container, improving the usage reliability of the storage container; in still another aspect, by separately arranging the press locking portion 6 and the lateral unlocking portion 7, unlocking by the user by pressing the press locking portion 6 is able to be avoided, thereby avoiding the problem that the user's hand feels a counter-pushing force due to the press locking portion springing up, further improving the user experience.

As shown in FIGS. 14 to 20, in embodiment III of the present disclosure, the press locking portion 6 is provided with a snap-fitting member 46, and the lateral unlocking portion 7 includes: an unlocking component 35, rotatably connected with the upper cover 5, the unlocking component 35 having a pressing part 36 and a snap-fitting part 37 oppositely arranged in an axial direction of the container cover 4, and a pivot point between the unlocking component 35 and the upper cover 5 being located between the pressing part 36 and the snap-fitting part 37; and an elastic component 12, providing a snap-fitting force for the snap-fitting part 37; when the press locking portion 6 is pressed downwards to the locking position, the snap-fitting member 46 is snap-fitted with the snap-fitting part 37; and when the pressing part is subjected to the lateral pressing force, the fitting between snap-fitting member 46 and the snap-fitting part 37 is released.

By the arrangement, the press locking portion 6 is pressed downwards, such that the snap-fitting member 46 of the press locking portion 6 is able to be snap-fitted with the snap-fitting part 37, so as to maintain, using the elastic component 12, the press locking portion 6 to be in the locking position; when the press locking portion 6 needs to be unlocked, the pressing part 36 of the unlocking component 35 is able to be pressed laterally so as to cause the unlocking component 35 to rotate against the elastic force of the elastic component 12, and the snap-fitting part 37 is able to be caused to move in a direction away from the snap-fitting member 46 so as to cause the snap-fitting part 37 to release the snap-fitting member 46, thereby causing the press locking portion 6 to switch from the locking position to an unlocking position.

As shown in FIGS. 14 to 20, in embodiment III of the present disclosure, the snap-fitting member 46 is a hook, and the hook is configured to be capable of snap-fitting with a bottom end of the unlocking component 35. In this way, it is convenient to achieve snap-fitting between the press locking portion 6 and the unlocking component 35. The bottom end of the unlocking component 35 forms the snap-fitting part 37.

In one embodiment, a snap groove is also able to be provided on the unlocking component 35, and the hook is snap-fitted with the snap groove.

As shown in FIGS. 14-20, in embodiment III of the present disclosure, one end of the elastic component 12 abuts against the snap-fitting part 37, and the other end of the elastic component 12 abuts against the upper cover 5. In this way, the elastic component 12 is able to maintain the press locking portion 6 to be in the locking position.

In one embodiment, the elastic component 12 is also able to be arranged between the pressing part 36 and the pivot point between the unlocking component 35 and the upper cover 5. When two ends of the elastic component 12 are respectively connected with the unlocking component 35 and the upper cover 5 and the press locking portion 6 is maintained in the locking position, the elastic component 12 is in a stretched state.

The elastic component 12 is, for example, a spring, and is able to be replaced with components having an elastic function such as an elastic block.

As shown in FIGS. 14 to 20, in embodiment III of the present disclosure, the unlocking component 35 is provided with a limiting portion 39, and the elastic component 12 is in limiting fit with the limiting portion 39. In this way, the separation of the elastic component 12 from the unlocking component 35 during the process of pressing the unlocking component 35 is able to be avoided, thereby increasing the structural stability.

In embodiment III of the present disclosure, the limiting portion 39 is a ring-shaped groove arranged on the unlocking component 35, and an end of the elastic component 12 is located in the ring-shaped groove.

Figure 18:
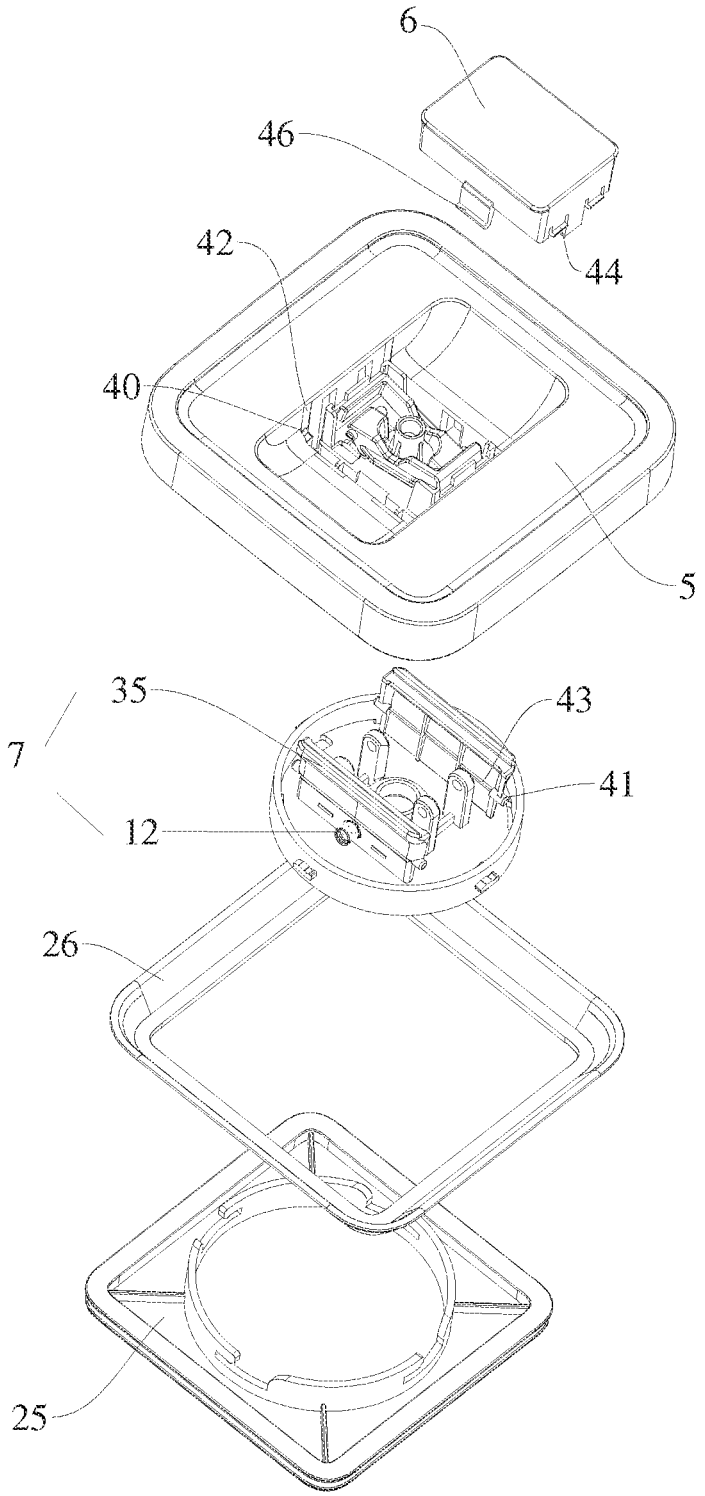
FIG. 18 is an exploded structural schematic diagram of the container cover of FIG. 15.

As shown in FIG. 18, in embodiment III of the present disclosure, in an axial direction of the container cover, the press locking portion 6 is arranged movably relative to the upper cover 5; the stop member 43 is provided on a side of the unlocking component 35 facing the press locking portion 6, and the stop member 43 is located between the pressing part 36 and the snap-fitting part 37 to prevent the press locking portion 6 from being separated from the lateral unlocking portion 7.

By this arrangement, when the pressing part 36 of the unlocking component 35 is pressed laterally to unlock the press locking portion 6, the press locking portion 6 springs up, and the stop member 43 is able to prevent the press locking portion 6 from being separated from the lateral unlocking portion 7.

In embodiment III of the present disclosure, the stop member 43 is a rib.

As shown in FIGS. 14 to 20, in embodiment III of the present disclosure, a mounting hole 40 is provided on the inner wall of the mounting recess 9, a rotating shaft 41 is provided on the unlocking component 35, and the rotating shaft 41 is rotatably fitted with the mounting hole 40. In this way, the unlocking component 35 is able to be rotatably connected with the upper cover 5, such that the unlocking component 35 and the press locking portion 6 are able to be snap-fitted or released from the fitting.

In embodiment III of the present disclosure, both sides of the unlocking component 35 are respectively provided with the rotating shaft 41, inner walls of both sides of the mounting recess 9 are respectively provided with the mounting hole 40, and two rotating shafts 41 are correspondingly rotatably connected to two mounting holes 40.

As shown in FIGS. 14 to 20, in embodiment III of the present disclosure, a guide groove 42 is further provided on the inner wall of the mounting recess 9, and the guide groove 42 extends from the mounting hole 40 to a top wall of the upper cover 5 in the axial direction of the container cover 4. In this way, when the unlocking component 35 is mounted, the rotating shaft 41 is able to slide along the guide groove 42, so as to facilitate mounting the rotating shaft 41 of the unlocking component 35 in the mounting hole 40.

In embodiment III of the present disclosure, the hook structure 44 and the snap-fitting member are located on different sides of the press locking portion 6, such that an interference between the hook structure 44 and the lateral unlocking portion 7 is able to be avoided.

Other structures of embodiment III are the same as those of embodiment I of the present disclosure, and are not repeated herein.

From the description above, it is able to be determined that the described embodiments of the present disclosure achieve the following technical effects: the storage container is provided with the press locking portion and the lateral unlocking portion, closing of the storage container is achieved by pressing the press locking portion downwards, and the opening of the storage container is achieved by laterally pressing the lateral unlocking portion; in this way, in one aspect, a user is able to apply the lateral pressing force on the lateral unlocking portion by holding the lateral unlocking portion, and is able to easily remove the container cover by lifting the container cover while holding the lateral unlocking portion by hand, being convenient and time-saving, improving the user experience; in another aspect, closing and opening require different force application directions and different operation positions, and thus opening cannot be achieved by pressing the press locking portion multiple times; and the opening of the storage container is achieved by applying the force to the lateral unlocking portion laterally, and the position is not easily touched, and thus the problem of unlocking by unintended touch cannot easily occur, effectively avoiding opening of the container cover of the storage container caused by unintended touch, improving the usage reliability of the storage container; in still another aspect, by separately arranging the press locking portion and the lateral unlocking portion, unlocking by a user by pressing the press locking portion is able to be avoided, thereby avoiding the problem that the user's hand feels a counter-pushing force due to the press locking portion springing up, further improving the user experience.

It should be noted that the terms used herein are for the purpose of describing particular embodiments only and are not intended to be limiting of exemplary embodiments in accordance with the present application. As used herein, the singular form is intended to include the plural form as well, unless the context clearly indicates, and further it should be understood that the terms "includes" and/or "including" when used in this description, specify the presence of features, steps, operations, devices, components, and/or combinations thereof.

It should be noted that the terms "first", "second" etc., in the description, claims, and drawings of the embodiments of the present disclosure are used to distinguish similar objects, and are not necessarily used to describe a specific sequence or order. It should be understood that the data so used may be interchanged wherein appropriate so that embodiments of the present disclosure described herein may be implemented in sequences other than those illustrated or described herein.

The above is only some embodiments of the embodiments of the present disclosure and is not intended to limit the embodiments of the present disclosure. A person skilled in the art may make various modifications and variations. Any modifications, equivalent replacements, improvements, etc.

made within the spirit and principle of the present disclosure shall all fall within the scope of protection of the present disclosure.

The invention claimed is:

1. A storage container, comprising:

a container body, provided with a storage cavity and an opening in communication with the storage cavity; and a container cover, covering the opening of the container body, the container cover comprising an upper cover, a press locking portion, a lateral unlocking portion, and a sealing cover, the upper cover being provided with a mounting recess, the press locking portion being movably arranged in the mounting recess, the lateral unlocking portion being arranged on a side portion of the press locking portion, and the sealing cover being linked to the press locking portion; when the press locking portion is pressed downwards to a locking position, the sealing cover is located in the storage cavity and closes the opening; and when subjected to a lateral pressing force, the lateral unlocking portion unlocks the press locking portion, thereby allowing the sealing cover to disengage from contact with the storage cavity, and enabling the sealing cover to opens the opening;

wherein the press locking portion is pressed, the press locking portion and the lateral unlocking portion move together to the locking position, the lateral unlocking portion is in locking fit with the upper cover; and when the lateral unlocking portion is subjected to the lateral pressing force, the lateral unlocking portion and the upper cover are unlocked, so as to unlock the press locking portion.

2. The storage container according to claim 1, wherein a first snap-fitting component is provided on the upper cover, the lateral unlocking portion comprises a second snap-fitting component and an elastic component; the second snap-fitting component is arranged on a side portion of the press locking portion, the elastic component is arranged between the second snap-fitting component and the press locking portion, and provides an elastic locking force for the second snap-fitting component; when the press locking portion is pressed downwards, the second snap-fitting component is able to be snap-fitted with the first snap-fitting component; and when the lateral unlocking portion is pressed, the second snap-fitting component is able to be separated from the first snap-fitting component, and the press locking portion is able to drive the sealing cover to open the opening.

3. The storage container according to claim 2, wherein a bottom wall of the upper cover is provided with an operating groove, and the second snap-fitting component is a hook;

when the press locking portion is pressed downwards, the hook is able to pass through the operating groove, and hook the bottom wall of the upper cover under an elastic locking acting force of the elastic component; and when the lateral unlocking portion is pressed, the hook is able to be separated from the bottom wall of the upper cover and reach an avoidance area of the operating groove, and the press locking portion is able to drive the hook to be separated from the operating groove.

4. The storage container according to claim 3, wherein a side wall of the mounting recess is provided with an avoidance groove, a first stop portion is formed at a bottom of the avoidance groove, and the hook hooks the bottom wall of the first stop portion once passing through the operating groove.

5. The storage container according to claim 3, wherein a side wall of the press locking portion is provided with an accommodating groove, a bottom wall of the accommodating groove is provided with a guide hole, a side of the hook facing the accommodating groove is provided with a guide post, the guide post is slidably arranged in the guide hole, the elastic component is sleeved on the guide post, and a first end of the elastic component abuts against the hook, and a second end of the elastic component abuts against the bottom wall of the accommodating groove.

6. The storage container according to claim 2, wherein the first snap-fitting component is connected to a bottom wall of the mounting recess, and the first snap-fitting component extends in a direction away from the sealing cover;

the second snap-fitting component is rotatably connected with the press locking portion, a side of the press locking portion facing the sealing cover is provided with a second stop portion, the second stop portion extends towards a side where the sealing cover is located, and the elastic component is provided between the second snap-fitting component and the second stop portion.

7. The storage container according to claim 6, wherein one of the first snap-fitting component and the second snap-fitting component comprises a hook member, the other of the first snap-fitting component and the second snap-fitting component is provided with a snap groove, and the hook member is able to be snap-fitted with the snap groove or separated from the snap groove.

8. The storage container according to claim 1, wherein the sealing cover comprises an inner cover, a support cover, and a flexible sealing portion, the inner cover is arranged in the support cover and is detachably connected with the support cover, and the flexible sealing portion is mounted on an outer periphery of the support cover; and/or both sides of the press locking portion are respectively provided with the lateral unlocking portion.

9. A storage container, comprising:

a container body, provided with a storage cavity and an opening in communication with the storage cavity; and a container cover, covering the opening of the container body, the container cover comprising an upper cover, a press locking portion, a lateral unlocking portion, and a sealing cover, the upper cover being provided with a mounting recess, the press locking portion being movably arranged in the mounting recess, the lateral unlocking portion being arranged on a side portion of the press locking portion, and the sealing cover being linked to the press locking portion; when the press locking portion is pressed downwards to a locking position, the sealing cover is located in the storage cavity and closes the opening; and when subjected to a lateral pressing force, the lateral unlocking portion unlocks the press locking portion, thereby allowing the sealing cover to disengage from contact with the storage cavity, and enabling the sealing cover to open the opening; wherein the press locking portion is arranged movably relative to the lateral unlocking portion; when the press locking portion is pressed downwards to the locking position, the press locking portion is in locking fit with the lateral unlocking portion; and when the lateral unlocking portion is subjected to the lateral pressing force, the press locking portion and the lateral unlocking portion are unlocked;

wherein the press locking portion is provided with a snap-fitting member, and the lateral unlocking portion comprises:

an unlocking component, rotatably connected with the upper cover, the unlocking component being provided with a pressing part and a snap-fitting part oppositely arranged in an axial direction of the container cover, and a pivot point between the unlocking component and the upper cover being located between the pressing part and the snap-fitting part; and an elastic component, providing a snap-fitting force for the snap-fitting part; when the press locking portion is pressed downwards to the locking position, the snap-fitting member is snap-fitted with the snap-fitting part; and when the pressing part is subjected to the lateral pressing force, the fitting between snap-fitting member and the snap-fitting part is released.

10. The storage container according to claim 9, wherein the snap-fitting member is a hook, and the hook is configured to be capable of snap-fitting with a bottom end of the unlocking component; or one end of the elastic component abuts against the snap-fitting part, and the other end of the elastic component abuts against the upper cover; or the unlocking component is provided with a limiting portion, and the elastic component is in limiting fit with the limiting portion.

11. The storage container according to claim 9, wherein a mounting hole is provided on an inner wall of the mounting recess, a rotating shaft is provided on the unlocking component, and the rotating shaft is rotatably fitted with the mounting hole.

12. The storage container according to claim 11, wherein a guide groove is further provided on the inner wall of the mounting recess, and the guide groove extends from the mounting hole to a top wall of the upper cover in the axial direction of the container cover.

13. A storage container, comprising:

a container body, provided with a storage cavity and an opening in communication with the storage cavity; and a container cover, covering the opening of the container body, the container cover comprising an upper cover, a press locking portion, a lateral unlocking portion, and a sealing cover, the upper cover being provided with a mounting recess, the press locking portion being movably arranged in the mounting recess, the lateral unlocking portion being arranged on a side portion of the press locking portion, and the sealing cover being linked to the press locking portion; when the press locking portion is pressed downwards to a locking position, the sealing cover is located in the storage cavity and closes the opening; and when subjected to a lateral pressing force, the lateral unlocking portion unlocks the press locking portion, thereby allowing the sealing cover to disengage from contact with the storage cavity, and enabling the sealing cover to open the opening; wherein the press locking portion comprises a pressing cover, and the pressing cover is slidably arranged in the mounting recess; an accommodating cavity is formed between the pressing cover and the upper cover; a connecting rod is provided on the sealing cover; the connecting rod passes through a bottom wall of the upper cover and extends into the accommodating cavity; a lever is provided in the accommodating cavity, a fulcrum of the lever is located on the upper cover, a first end of the lever is hinged to the connecting rod, and a second end of the lever cooperates with the pressing cover; the sealing cover comprises a flexible sealing portion, and the flexible sealing portion has a tapered structure gradually expanding in a direction towards the upper cover; the upper cover comprises a protruding ring, and the protruding ring corresponds to the flexible sealing portion; and when the press locking portion is pressed downwards, the second end of the lever is pressed downwards, the first end of the lever is lifted up to drive the sealing cover to move upwards, and the flexible sealing portion expands outwards under a squeezing effect of the protruding ring, such that press sealing is formed between the flexible sealing portion and an inner wall of the storage cavity of the container body.

14. The storage container according to claim 13, wherein a number of levers is two, and the two levers are arranged symmetrically about a center of the press locking portion.

15. The storage container according to claim 13, wherein the bottom wall of the upper cover is provided with a protruding post protruding upwards, the protruding post is internally provided with a guide hole, the pressing cover is provided with a guide rod, and the guide rod is slidably arranged in the guide hole; and/or the second end of the lever is of an L shape.

16. The storage container according to claim 13, wherein a guide slope is provided on an outer wall of an end facing the flexible sealing portion of the protruding ring; and when the press locking portion is in an unlocking state, an outer edge of an end portion of a side of the flexible sealing portion facing the protruding ring is located on an outer side of an outer wall of the protruding ring.

17. The storage container according to claim 16, wherein the protruding ring extends into the storage cavity, and a gap between the outer wall of the protruding ring and the inner wall of the storage cavity is less than a thickness of the flexible sealing portion.

18. The storage container according to claim 13, wherein a return spring is provided between the upper cover and the sealing cover, a first end of the return spring abuts against the bottom wall of the upper cover, and a second end of the return spring abuts against the sealing cover.

* * * * *